US005562053A

United States Patent [19]

Lim

[11] Patent Number: 5,562,053

[45] Date of Patent: Oct. 8, 1996

[54] TUNNEL INCINERATOR

[76] Inventor: Kyung-suk Lim, 211-1, Maesanri, Opomyun, Kwangiukun, Kyunggido, Rep. of Korea

[21] Appl. No.: 329,971

[22] Filed: Oct. 27, 1994

[30] Foreign Application Priority Data

Oct. 27, 1993 [KR] Rep. of Korea ..... 93-22482

[51] Int. Cl.[6] ..... A47J 36/00

[52] U.S. Cl. ..... 110/246; 110/255; 432/107; 432/114

[58] Field of Search ..... 110/246, 255, 110/257; 432/105, 107, 111, 112, 114

[56] References Cited

U.S. PATENT DOCUMENTS

| | | | |
|---|---|---|---|
| 3,916,807 | 11/1975 | Eiki | 110/246 |
| 4,175,335 | 11/1979 | Avril | 432/114 |
| 4,376,343 | 3/1983 | White et al. | 432/107 |
| 5,338,188 | 8/1994 | Yocum | 110/246 |
| 5,361,708 | 11/1994 | Barnes | 110/246 |
| 5,390,630 | 2/1995 | Virr | 110/246 |

*Primary Examiner*—John T. Kwon
*Attorney, Agent, or Firm*—Staas & Halsey

[57] ABSTRACT

A tunnel type incinerator with cylindrical inner and outer barrels which are rotated in opposite directions relative to each other. A large number of crushing blades or protrusions are disposed and engaged with each other in a spiral shape on the wall of the barrels, a hopper is disposed on a side of a hold member which is joined with the inner and outer barrels and a bucket is disposed on a lower opposite side of the hold member. Charged waste from the hopper is crushed on the crushing blades and moved to the front end portion of the barrel by a screw ribbon and burned up by the indirect heating of a combustion tube with burners, and a non combustioned gas tube is mounted over the hold member, such that the non combustioned gas produced in the inner and outer barrels is recycled to burn up the non combustioned gas. The combustion tube is mounted on inside walls of the inner and outer barrels in a zigzagged shape, thus the disintegrated and burnt waste are moved to a discharge opening and a discharge piece through an opening of the front end portion of the inner barrel, and moved to a re-charge inlet by a screw blender of a bucket installed on the hold member.

13 Claims, 5 Drawing Sheets

TUNNEL INCINERATOR

FIELD OF THE INVENTION

The present invention relates to an incinerator, and particularly, to a tunnel type incinerator to burned up industrial waste.

BACKGROUND ART

Waste incinerators are well known devices which support and confine waste as it is burned and then transport burned waste out of the combustion area for disposal.

U.S. Pat. No. 3,646,898, issued to Bavers on Mar. 7, 1972, shows such an incinerator including a horizontally disposed rotating cage for separating irreducible materials from ash.

Also, U.S. Pat. No. 4,430,950, issued to Foresto on Feb. 14, 1984, discloses an incinerator for burning waste material and employs an additional grate on which waste material is burned, thereby producing a layer of heated ashes and coke, such that the smoke and gases produced by the burning waste material are caused to be passed downwardly through a very hot layer of coke.

U.S. Pat. No. 4,434,725, issued to Foresto on Mar. 6, 1984, entitled "Mass burning self-cleaning incinerator", discloses a plurality of refuse burning grates spaced one above the other. The refuse is supplied to and deposited selectively on selected ones or all of the grates while the grates are rotating so as to evenly distribute the refuse thereon.

SUMMARY OF THE INVENTION

The present invention provides a tunnel type incinerating system, including a cylindrical over barrel and a cylindrical outer barrel rotating in opposite directions with respect to each other, and a large number of crushing blades or protrusions are disposed and engaged with each other in a spiral shape on the walls of the barrels, a hopper is disposed on a side of a hold member which joins with the barrels and a bucket is disposed on a lower opposite side of the hold member, charged waste from the hopper is crushed on the crushing blades and moved to the front end portion of the barrels by a screw ribbon and burned up by the indirect heating of a combustion tube with burners, and a non combustioned gas tube is mounted over the hold member, and may be recycled to burn up the non combustioned gas produced in the barrels, the combustion tube being located inside the inner barrel in a zigzaged shape, thus the disintegrated and burnt waste is moved to a discharge opening and a discharge piece through the opening of the front end portion of the inner barrel, and moved to a re-charge inlet by a screw blender of a bucket installed on the head member.

Therefore, the present invention solves the counterpart problems of the prior art, and reduces the harmful gas, space required and refusal ash.

The manner in which these and other objects are accomplished by the present invention will be set forth in the following detailed description.

DETAILED DESCRIPTION OF THE PREFERRED EMBODIMENT

Figure 1:
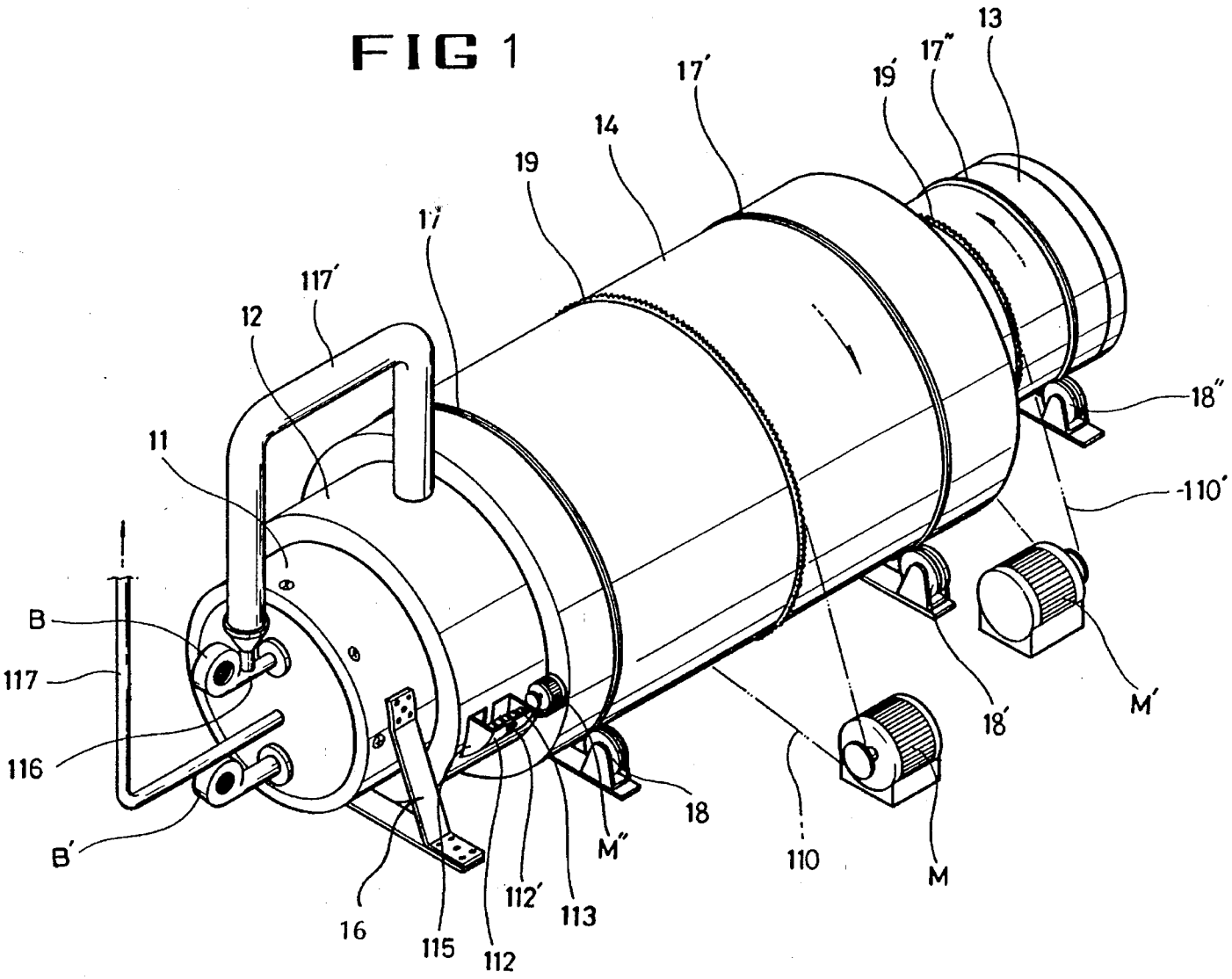
FIG. 1 is a perspective view of a tunnel incinerator of a preferred embodiment of the present invention.

Referring now to the figures of the drawings, and in particular to FIG. 1, a tunnel type incinerator according to the present invention includes a hold member 12 and a head member 11 joined with cylindrical inner barrel 13 and outer barrel 14. The head member 11 is mounted on a support 16.

The barrels 13, 14 are mounted on the rollers 18, 18', 18", horizontally with the guide rails 7, 7', and 7" which are disposed on the circumference of the barrels 13, 14. The sprockets 19, 19' are mounted on the middle and rear positions of the barrels 13, 14, respectively and rotated by the chains 110, 110' and motors M, M', respectively.

The inner barrel 13 and outer barrel 14 are rotated in opposite directions and move relative to the hold member 12.

Figure 3:
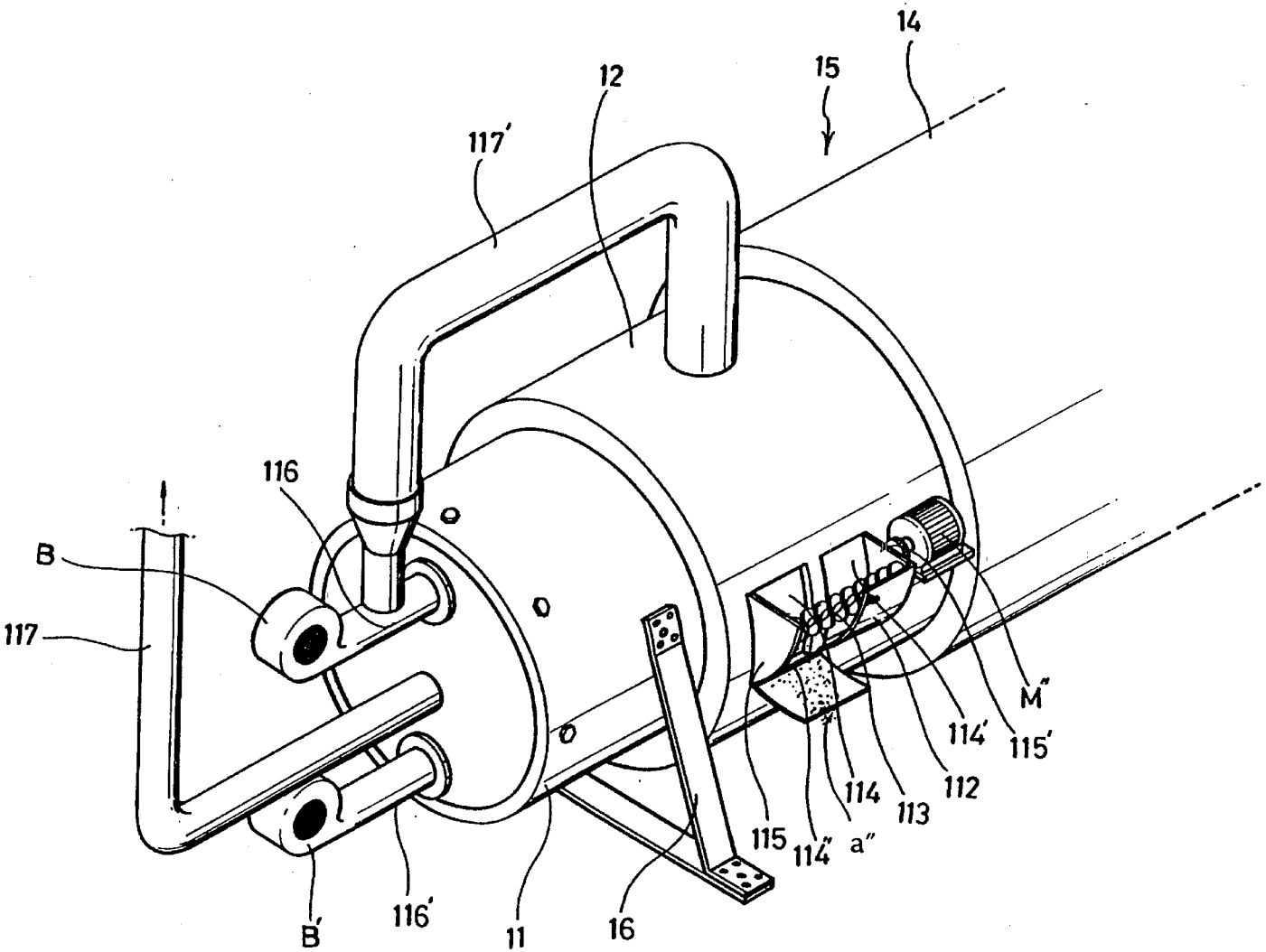
FIG. 3 is a partly perspective view of the tunnel incinerator of the preferred embodiment of the present invention.
Figure 5:
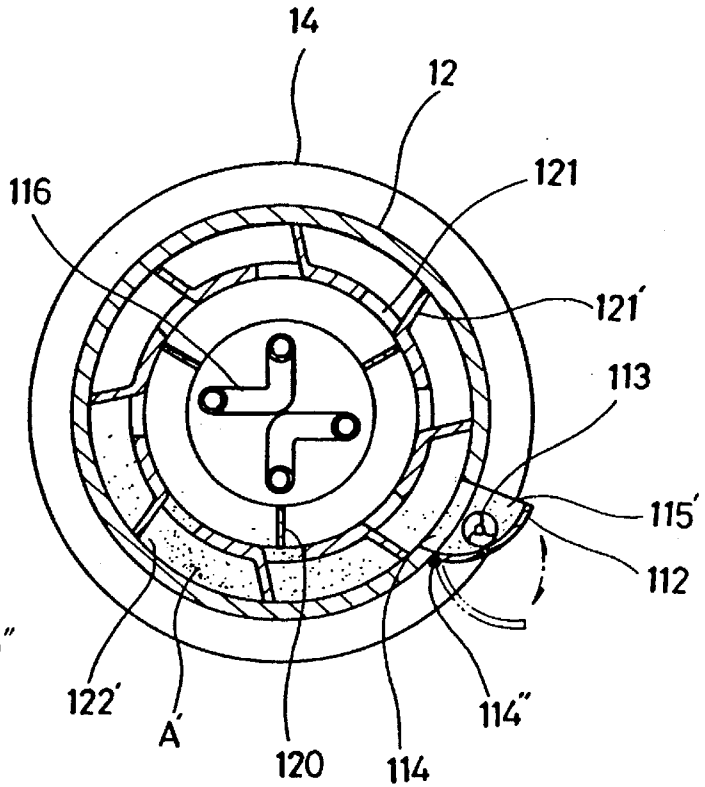
FIG. 5 is a cross sectional view along the I—I line of FIG. 2.
Figure 4:
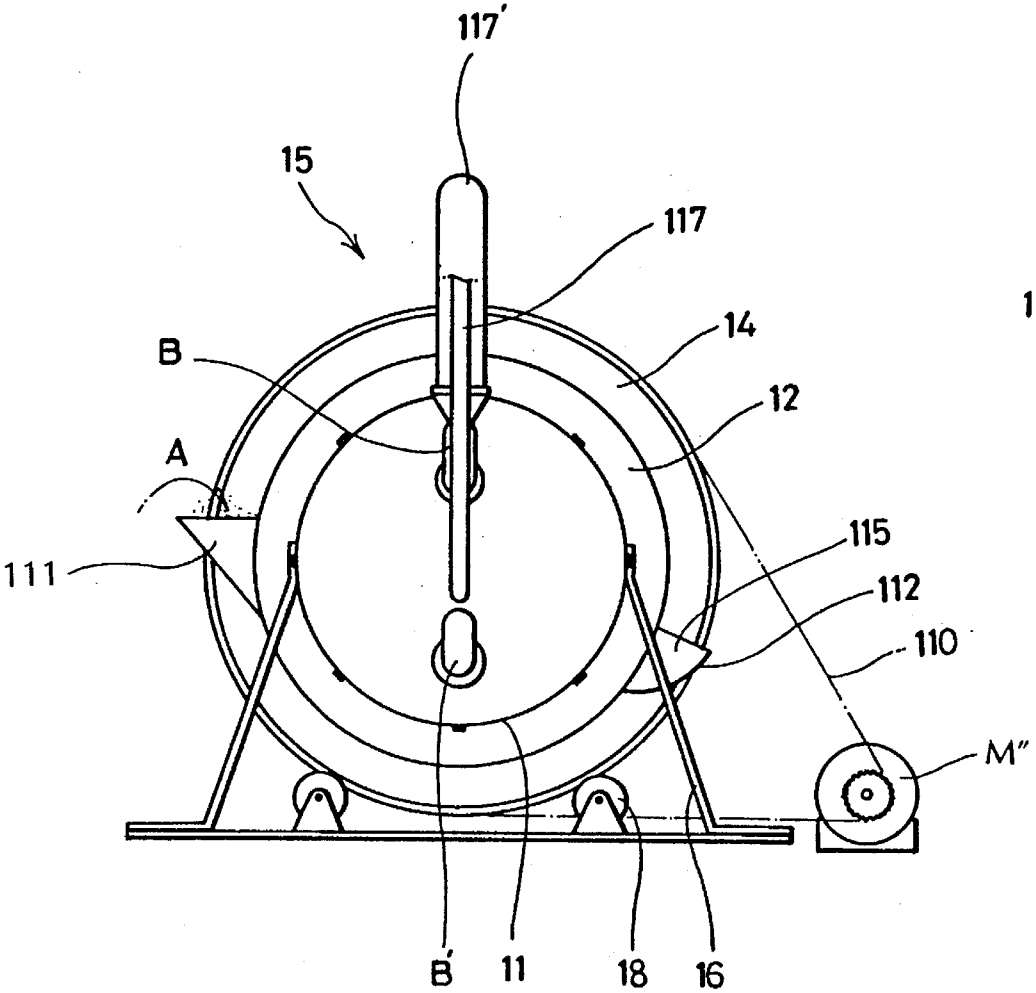
FIG. 4 is a side view of FIG. 3.

In FIGS. 4 and 5, a hopper 111 is disposed on a side of the hold member 12, and a bucket 112 is disposed on a lower opposite side of the hold member 12. A screw blender 113 is driven by a geared motor M", and disposed on the support pieces 115, 115', near the discharge opening 114 and recharge opening 114' (see FIG. 3).

A part of the bucket 112 may be opened at the lower part of the discharge opening 114 by a hinge 114".

The numeral 112" is a hanger.

In FIG. 3, the burners B, B' are installed with firing (combustion) tubes 116, 116' on the head member 11, horizontally through the inner barrel 13.

An end of the firing tube 116 is connected to a chimney 117 positioned in the center portion between the burners B, B'.

The firing tube 116 is installed with a zigzagged shape in the center of an inner portion 13*a* (see FIG. 2) of the barrel 13.

A non combustioned gas tube 117' is mounted over the hold member 12, to recycle and burn up the non combustioned gas produced in barrels 13, 14.

Figure 2:
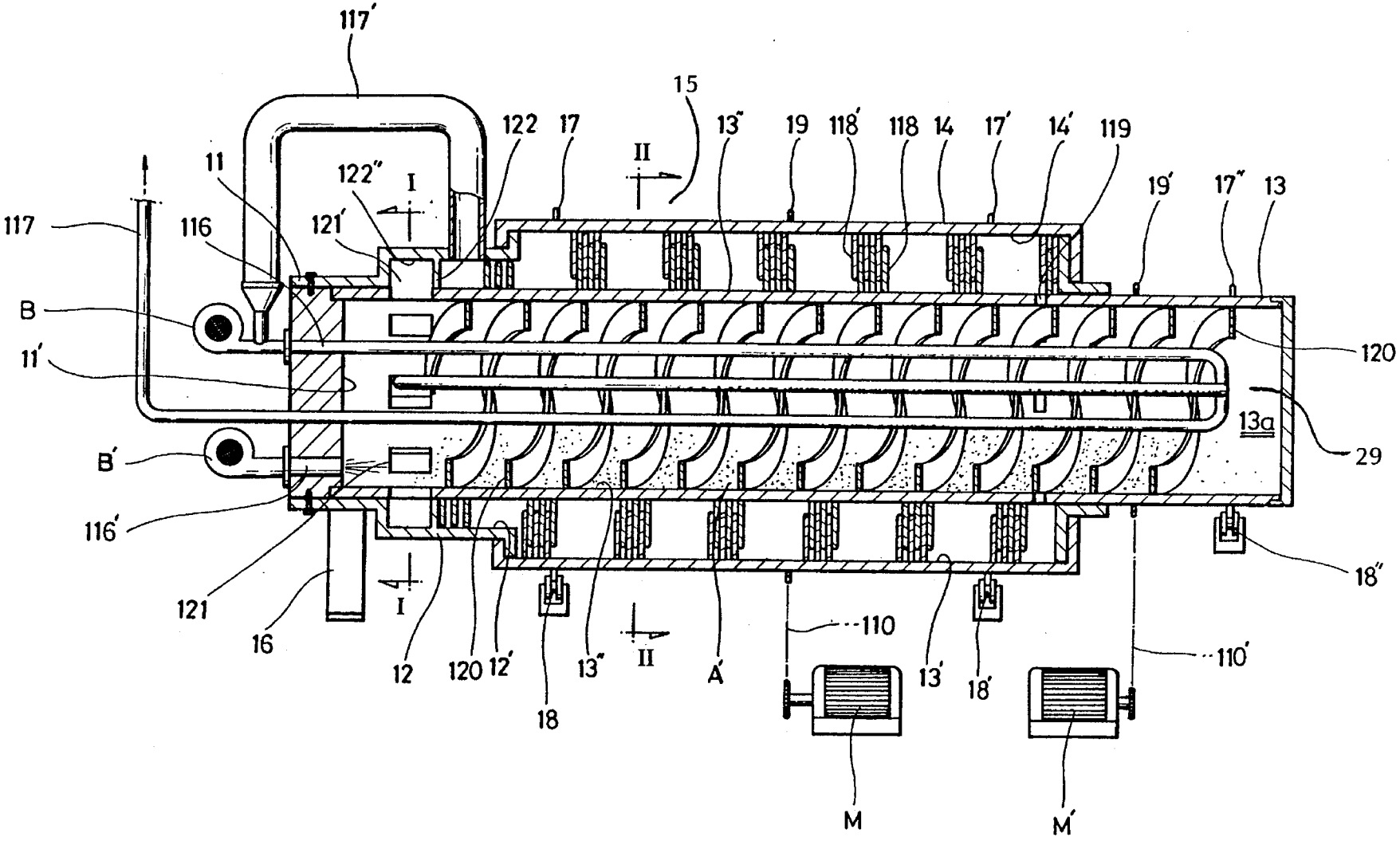
FIG. 2 is a cross sectional view of the tunnel incinerator of the preferred embodiment of the present invention.
Figure 6:
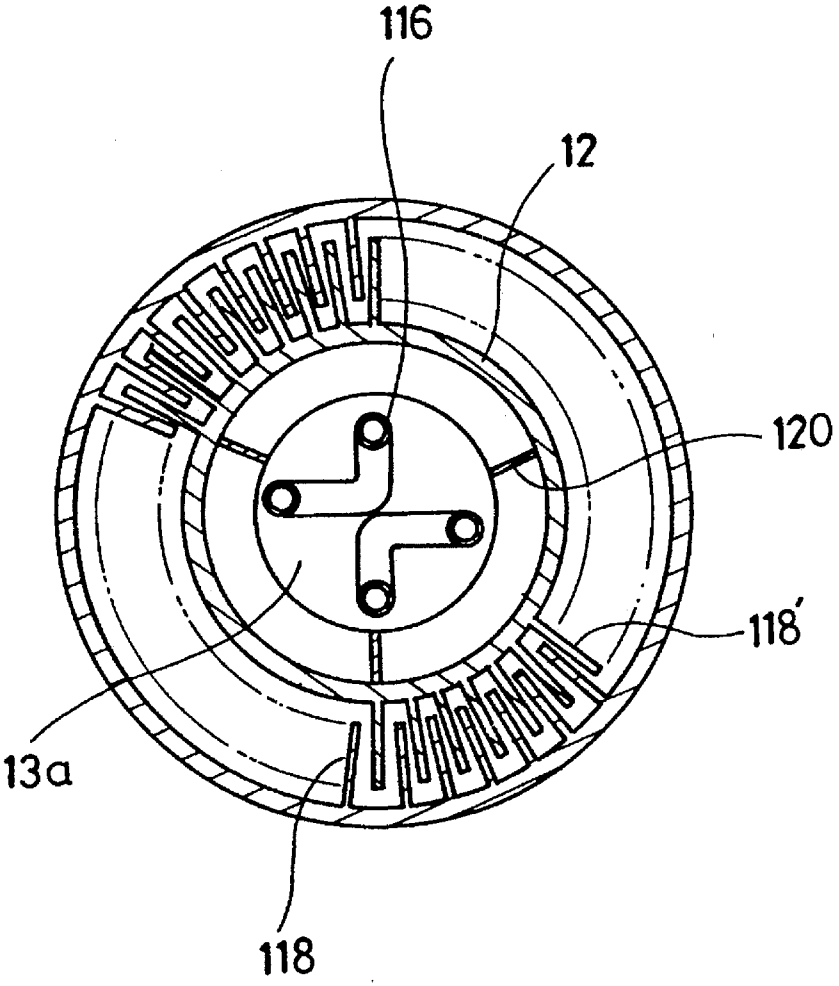
FIG. 6 is a cross sectional view along the II—II line of FIG. 2.

In FIG. 2, in the burn up furnace 15, a large number of crushing blades 118, 118' are disposed and engaged with each other in a spiral shape on the barrel walls 13', 14' of the barrels. FIG. 6 shows a cross-sectional view along the I—I line of FIG. 2.

A spiral ribbon 120 is provided on the inner barrel 13 to transport the crushed waste A' from the inlet opening 119 of the rear portion of the inner barrel 13 to the front end portion 11' of the inner barrel 13.

A discharge opening 121 and a discharge piece 121' are disposed on the circumference of the front end portion 11' of the inner barrel 13, the discharge piece 121' is engaged with the groove 122' which is provided with the barrier wall 122 of the inside wall 12' of the hold member 12, and the discharge opening 121 and the discharge piece 121' are disposed on the line to communicate with the discharge opening 114.

The inner barrel 13 is rotated in the opposite direction relative to the rotating direction of the outer barrel 14.

The crushed waste A is moved to the front end portion 11' by the transportation spiral ribbon 120, and burned up to ash by the heat of the combustion tube 116, and is removed through the discharge opening 121, the discharge piece 121', to the discharge opening 114.

At the start of the operation, the motors M, M', M" and burners B, B' are switched on and operated to heat fire the furnace 15, and waste A (see FIG. 4) is sent from an inlet (hopper) 25 to the space between the barrels 13 and 14 through the hopper 111.

The waste A is disintegrated by the crushing blades 118, 118', and moved to the rear portion of the barrels 13, 14, then moved to the inside portion 3*a* of the inner barrel 13 via rear charge inlet 119 of the inner barrel 13. The disintegrated waste A' is transferred while being mixed to the front end portion 11' and burned up by the heating of combustion tubes 116, 116' with the burners B, B'.

The non combustioned gas produced by the indirect heat of combustion tubes 116, 116' in between the inner barrel 13 and the outer barrel 14, is re-mixed and combustioned in combustion tube 116 through the non-combustion tube 117'.

Thus, the vent gas of the chimney 117 is not harmful to the environment.

The burned up refuse (disintegrated waste) A' is moved to the discharge piece 121', through the discharge opening 121 and removed from the discharge opening 114. The above action is carried out easily by the grooves 122' in the hold member 12 with the barrier wall 122.

The disintegrated waste A' which is moved to the discharge opening 114 may be re-cycled and charged to re-charge opening 114' by the screw ribbon 113 which is driven by the geared motor M", and then, re-cycling of the burned up operation is established, thus, minimizing the amount of burnt-up refuse a" (see FIG. 3), and discharge of the burnt-up refuse is carried out easily by the opening of the bucket hanger 112' when the burnt-up refuse a" overflows the inner barrel 13.

I claim:

1. A tunnel type incinerator to burn up waste, comprising:

a cylindrical outer barrel;

a cylindrical inner barrel formed within said outer barrel and having an inlet opening at a rear portion and a first discharge opening at a front portion, wherein said inner and outer barrels rotate in opposite directions with respect to each other;

a plurality of crushing blades formed in a spiral shape, wherein ones of said crushing blades extend outwardly at intervals from an outer wall of said inner barrel and the other ones of said crushing blades extend inwardly from an inner wall of said outer barrel in between said ones of said crushing blades;

a hold member which joins said inner and outer barrels, and has a second discharge opening and a re-charge inlet next to each other;

a hopper disposed on a side of said hold member;

a screw ribbon formed in an inner portion of said inner barrel a head member having a combustion tubes with burners formed at an inner wall thereof at the front portion of said inner barrel;

a bucket disposed on a lower opposite side of said hold member immediately below said second discharge opening and said re-charge inlet and having a screw blender, wherein the waste is placed between said inner and outer barrels at the front end portions thereof, crushed and driven to said inlet opening to allow the crushed waste to fall into the inner portion of said inner barrel, the crushed waste being moved to the front portion of said inner barrel and burned up by indirect heating of the combustion tube;

a non combustioned gas tube mounted over said hold member, to direct the non combustioned gas formed by the indirect burning of the crushed waste to said combustion tube to be burned up; and wherein the burned up waste is moved from the first discharge opening to the second discharge opening, caught by said bucket one of removed from the incinerator and moved to said re-charge inlet by said screw blender to be reintroduced to the inner portion of said inner barrel for burning.

2. The tunnel type incinerator of claim 1, wherein said hold member and said head member are joined with said inner and outer barrels.

3. The tunnel type incinerator of claim 2, further comprising a support on which said head member is mounted.

4. The tunnel type incinerator of claim 1, further comprising:

sprockets mounted on circumferences of said inner and outer barrels;

motors;

chains to link said motors with said sprockets to rotate said inner and outer barrels;

guide rails formed on the circumferences of said inner and outer barrels; and rollers, wherein said inner and outer barrels lie horizontal on said rollers, and said rollers engage said guide rails to guide the rotation of said inner and outer barrels.

5. The tunnel type incinerator of claim 1, wherein said inner and outer barrels are rotated on said hold member and in opposite directions with respect to each other.

6. The tunnel type incinerator of claim 1, further comprising:

support pieces to support said screw blender in said bucket; and a geared motor to drive said screw blender.

7. The tunnel type incinerator of claim 6, further comprising:

a hanger to support said bucket; and a hinge formed at a lower part of said bucket, to allow a portion of said bucket supported by said hinge to open.

8. The tunnel type incinerator of claim 1, further comprising a chimney connected to an end of one of said combustion tubes and positioned in between said burners, wherein said burners extend horizontally within said inner barrel from the inner wall of said head member.

9. The tunnel type incinerator of claim 1, wherein one of said combustion tubes has a zigzagged shape and is installed in a center region of the inner portion of said inner barrel.

10. The tunnel type incinerator of claim 1, wherein said non combustioned gas tube directs the non combustioned gas formed by the indirect burning of the crushed waste, wherein the non combustioned gas forms between said inner and outer barrels.

11. The tunnel type incinerator of claim 1, further comprising a discharge piece between said inner barrel and said hold member to direct the burned up waste from said first discharge opening to said second discharge opening.

12. A process for incineration of waste by an incinerator, comprising:

crushing the waste between cylindrical inner and outer barrels with crushing blades, wherein the inner barrel is within the outer barrel;

moving the waste to end portions of the inner and outer barrels and dropping the crushed waste into an inner portion of the inner barrel through an inlet of the inner barrel;

transferring the crushed waste to a front portion of the inner barrel and burning the crushed waste at the front portion;

collecting and burning the non combustioned gas which is formed between the inner and outer barrels by the burning of the crushed waste, and venting the burned up gas from the incinerator;

removing the burned up waste from the inner barrel to a container; and one of recycling the burned up waste into the inner barrel and removing the burned up waste from the container.

13. The process of claim 12, further comprising moving the burned up waste from a position of removal from the inner barrel to a position of reentry within the inner barrel by using a screw ribbon placed within the container.

* * * * *